US005261723A

United States Patent [19]

Hosoe

[11] Patent Number: 5,261,723

[45] Date of Patent: Nov. 16, 1993

[54] ERGONOMIC CHAIR HAVING THE SEAT AT A VARYING POSITION

[76] Inventor: Isao Hosoe, Via Voghera, 11, Milano, Italy

[21] Appl. No.: 920,007

[22] Filed: Jul. 27, 1992

Related U.S. Application Data

[63] Continuation-in-part of Ser. No. 474,807, Jun. 27, 1990, filed as PCT/IT88/00088, Dec. 23, 1988, abandoned.

[30] Foreign Application Priority Data

Dec. 28, 1987 [JP] Japan ..... 62-329925

[51] Int. Cl.[5] ..... A47C 1/02

[52] U.S. Cl. ..... 297/344.14; 297/322

[58] Field of Search ..... 297/345, 313, 322, 337, 297/DIG. 10, 258, 325, 261

[56] References Cited

U.S. PATENT DOCUMENTS

| | | | |
|---|---|---|---|
| 1,544,187 | 6/1925 | Schroeder | 297/322 X |
| 2,355,762 | 8/1944 | Van Derveer | 297/313 |
| 3,342,526 | 9/1967 | Sereda | 297/258 |
| 3,851,917 | 12/1974 | Horstmann et al. | 297/345 |
| 4,946,222 | 8/1990 | Matson | 297/345 |

FOREIGN PATENT DOCUMENTS

| | | | |
|---|---|---|---|
| 0205097 | 12/1986 | European Pat. Off. | 297/325 |
| 2438781 | 2/1976 | Fed. Rep. of Germany | 297/258 |
| 312213 | 7/1969 | Sweden | 297/261 |
| 327448 | 4/1930 | United Kingdom | 297/337 |

*Primary Examiner*—Kenneth J. Dorner
*Assistant Examiner*—J. Bonifanti

[57] ABSTRACT

An ergonomic chair has its seat portion (4) which, in addition to be adjustable as to the height, forms a variable tilting angle, positive or negative with respect to the horizontal, in consequence of the height thereof, said tilting angle being obtained through a swinging movement of the seat (4) such as to form an arc of circumference about a rotation center substantially coincident with the center of gravity (CG) of a person sitting on the chair. This swinging movement of the seat is preferably accompanied by the rotation of a lever arm (6) pivotedly mounted at an end (6*a*) to the stationary portion (1*a*) of the seat support (1) and hinged at the other end (6*b*) to the front side of the seat (4), the length of said lever (6) or the pivoting point with seat (4) being adjustable by a simple operation of the user to modify the variation of the tilting angle of the seat (4) in function of its height. Said lever arm (6) may be provided with some elastic feature.

9 Claims, 8 Drawing Sheets

Fig.4
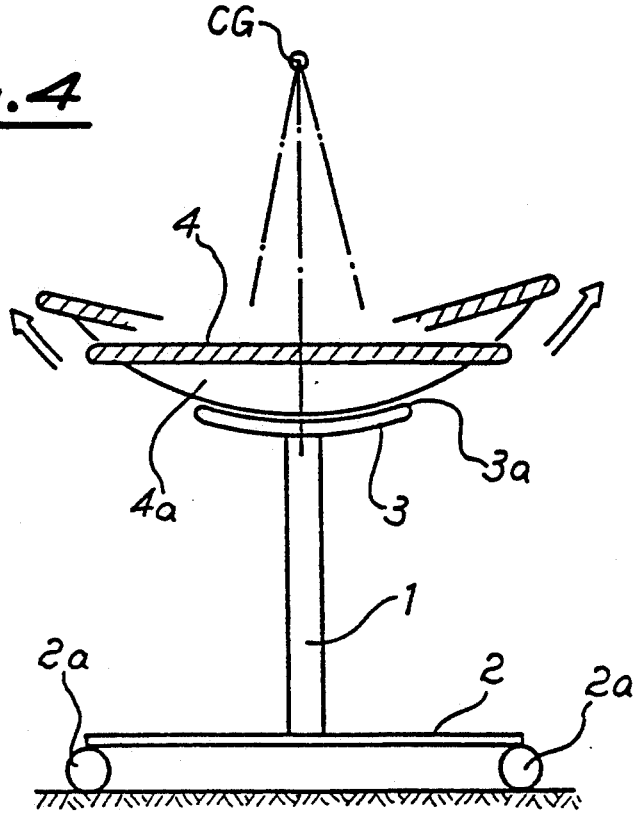
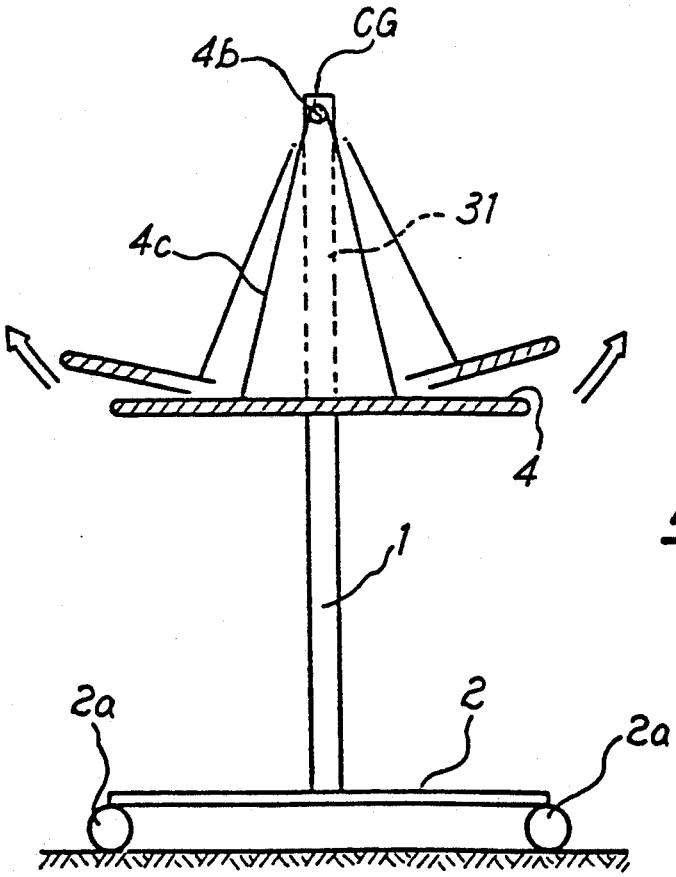
Fig.5

Fig. 7a
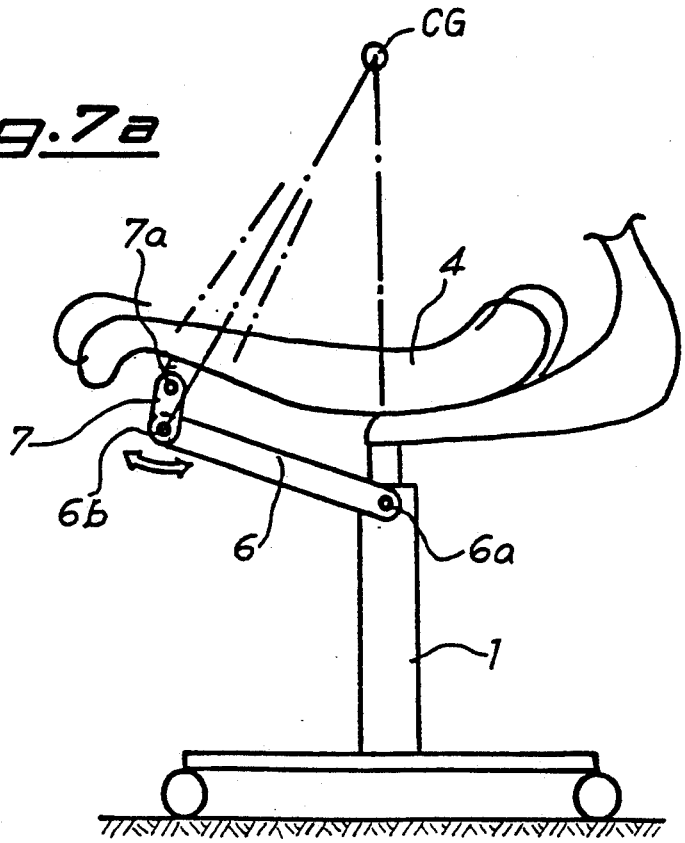
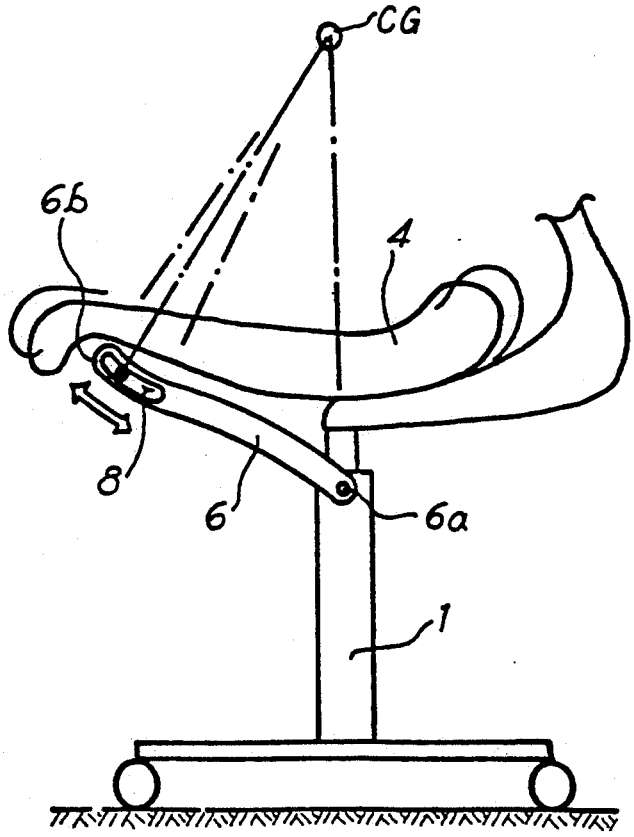
Fig. 7b

ERGONOMIC CHAIR HAVING THE SEAT AT A VARYING POSITION

This application is a continuation-in-part of application Ser. No. 07/474,807, filed Jun. 27, 1990, filed as PCT/IT88/00088, Dec. 23, 1988, now abandoned.

The present invention relates to an ergonomic chair the seat portion of which can change its position for a better adaptation to the user's height and the level of the work table in front of which the user is seating.

It is known that some types of chair for use in an office or the like have a function which allows the height of a seat portion to be freely changed in accordance with the physique of a sitting person, the height of a desk employed and so forth.

Another type of chair is also known in which the angle of its seat portion can be tilted in a certain range toward the front and rear side of the seat portion in accordance with the intention of a sitting person. The function which allows adjustment of the height of a seat portion and the mechanism causing the seat portion to swing in a plane perpendicular to the work surface were devised as a result of a pursuit of a chair which allows a person to sit thereon at a height matching the height of the top plate of a desk or table employed, as well as on which a person can sit comfortably from the viewpoint of ergonomics and hence without experiencing fatigue or assuming any unnatural posture even if he continues to sir for a long time.

Chairs of almost all the conventional types each having a seat portion of different height can only be used in combination with desks having a top plate provided at substantially the same height. Conventionally, the top plates of tables or the like with substantially the same height have been used of chairs for use with such top plates have been limited to a certain range.

On the other hand the rapid introduction of so-called office automation on the basis of the recent development of electronic techniques and computers compels offices to introduce various desks or the like in which each of the working surfaces or top plates greatly differ from one another, with the working place being now characterized by volumes having different vertical extensions, instead of a simple horizontal surface. In this situation, it has been desired to provide a chair having the function which allows the height of a seat portion to be adjusted in accordance with various top plates which greatly differ from one another in height.

In other words, in an office in which advanced office automation has been introduced, but also in different situations such as a doctor's or dentist's surgery, or in any case when a person must perform a variety of tasks in front of work surfaces having different heights, it will be necessary to introduce a chair which can be easily adapted to the user's requirements according to the various working surfaces (or top plates) which greatly differ from one another in height.

However, in a conventional type of chair which allows adjustment of the height of a seat portion or has a seat portion can only be adjusted in a state wherein the seat portion is allowed to swing back and forth within a limited range. Accordingly, if the height of the seat portion of such a seat is greatly changed and the seat is combined with desks having top plates which greatly differ from one another in height, a sitting person cannot assume a posture which is desirable from the viewpoints of ergonomics. Accordingly, a chair on which a person can sit confortably will have to be found out among the conventional chairs and giving up the adjustability in height.

EP-A-0 250 207 shows for example an adjustable chair the seat of which is mounted on a base by pivotal support members forming with the seat and base a quadrilateral linkage, but without any connection with the adjustability of the seat as to the height, which is not provided.

As a matter of fact the swinging axis about which the seat portion swings back and forth is generally located below the seat portion in any position. This also happens for the chair according to EP-A-0 250 207, as the rotation axes of the quadrilateral linkage are all under, or at maximum on the same plane of the seat portion. Therefore, since the center of gravity of a person sitting on the chair is shifted up and down or back and forth by the swinging motion, it is impossible to avoid changes in position energy and there is a risk of compelling the sitting person to assume an unnatural posture which is not only tiring but also unstable and dangerous.

FR-A-958 120 provides a chair having the seat adapted to swing about an axis which is above the seat portion and, in order to prevent the chair from possible overturning, is positioned at about the center of gravity of the whole (chair and sitting person). However also this chair is not adjustable as to the height of the seat.

It is an object of the present invention to provide an ergonomic chair, having a seat adjustable as to the height, capable to overcome the above-mentioned inconveniences and drawbacks of the prior art and in particular such as to keep the center of gravity of a person sitting thereon as much as possible along a vertical axis within the base polygon upon variation of the seat height and tilting angle.

This object is obtained by means of a chair with variable position of the seat support portion which is adjustable in height comprising, on a support base, a central vertical support formed of a stationary lower portion and an upper portion which can be moved with respect to the lower portion, with a seat support mounted to said upper mobile portion being adjustable in a known manner as to the height with respect to said lower portion of the central support, characterized by the fact of comprising means which cause the tilting angle of the seat portion to change with respect to the horizontal in accordance with changes in the height of the seat portion by a swingable movement along an arc of circumference about a center of rotation substantially coincident with the average position of the center of gravity of a person sitting on the chair.

In two alternative embodiments the above-mentioned seat support comprises either: a) a horizontal portion for supporting said seat support being provided with a slide or guide part shaped as an arc of circumference having the center in said center of rotation, along which a correspondingly shaped lower surface of said seat portion is moveable, or b) an associate side upright support extending from the upper portion of the vertical support, as said seat portion is supported, on at least one side, by a suspending arm which extends upwardly, being hinged at an upper end substantially coincident with said rotation center, to the associate side upright support.

In both alternative embodiments of the invention, said swinging movement of the seat is accompanied by the rotation of a lever arm pivotedly mounted at an end of the stationary part of a support of said seat and at the other end to the front side of the seat portion, wherein the length of said lever arm, or the point at which it is pivoted to the chair, can be possibly changed according to the user's height and will.

Thereby, when the height of seat of the chair according to the invention is changed, not only the tilting angle of the seat is modified as a consequence of a swinging movement about the center of gravity of the sitting person, but the latter can adapted the variation of such an angle as a function of the seat height, according to his own height or however his willing so as to assume the mostly desirable posture, whichever the seat height may be.

The advantages and features of the chair according to the invention will become clearer on the ground of the following description given by way of a non-limiting example with reference to the drawings in which:

FIGS. 1*a*–1*c* are diagrammatic side elevation at views showing various posture taken by persons sitting on conventional chairs with a tiltable seat, adjustable as to the height;

FIGS. 2*a*–2*c* are diagrammatic side views, similar to the preceding ones, of the positions taken by a chair provided with a seat according to the invention showing also the relationship existing between the seat height and the tilting angle and at the same time the corresponding postures of a person sitting on said chair;

FIG. 4 and FIG. 5 are diagrammatic side elevational views of two alternative embodiments of the seat portion only of a chair according to the invention;

Figure 6B:
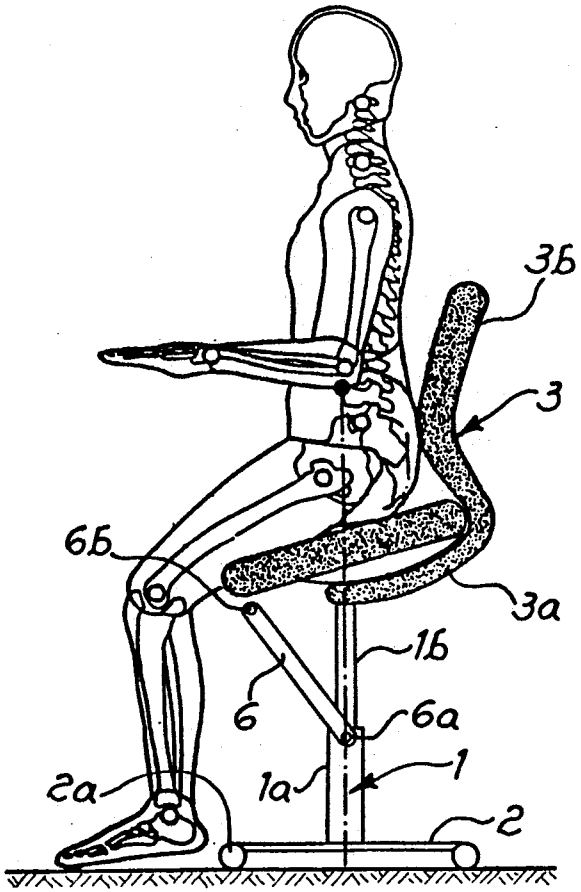
Figure 6A:
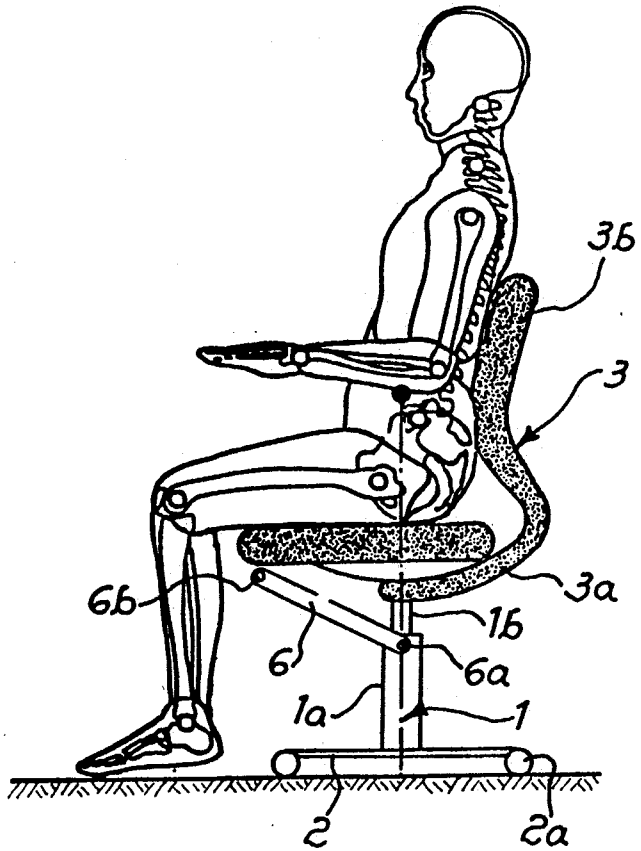

FIGS. 6*a* and 6*b* show two diagrammatic side views, at different heights of the seat, of a chair according to the invention in a preferred embodiment; and FIGS. 7*a* and 7*b* are two diagrammatic side views of the seat portion only of a chair according to FIGS. 6*a* and 6*b*, each of which shows a constructive possibility of a mostly preferred embodiment of said seat.

Figure 8A:
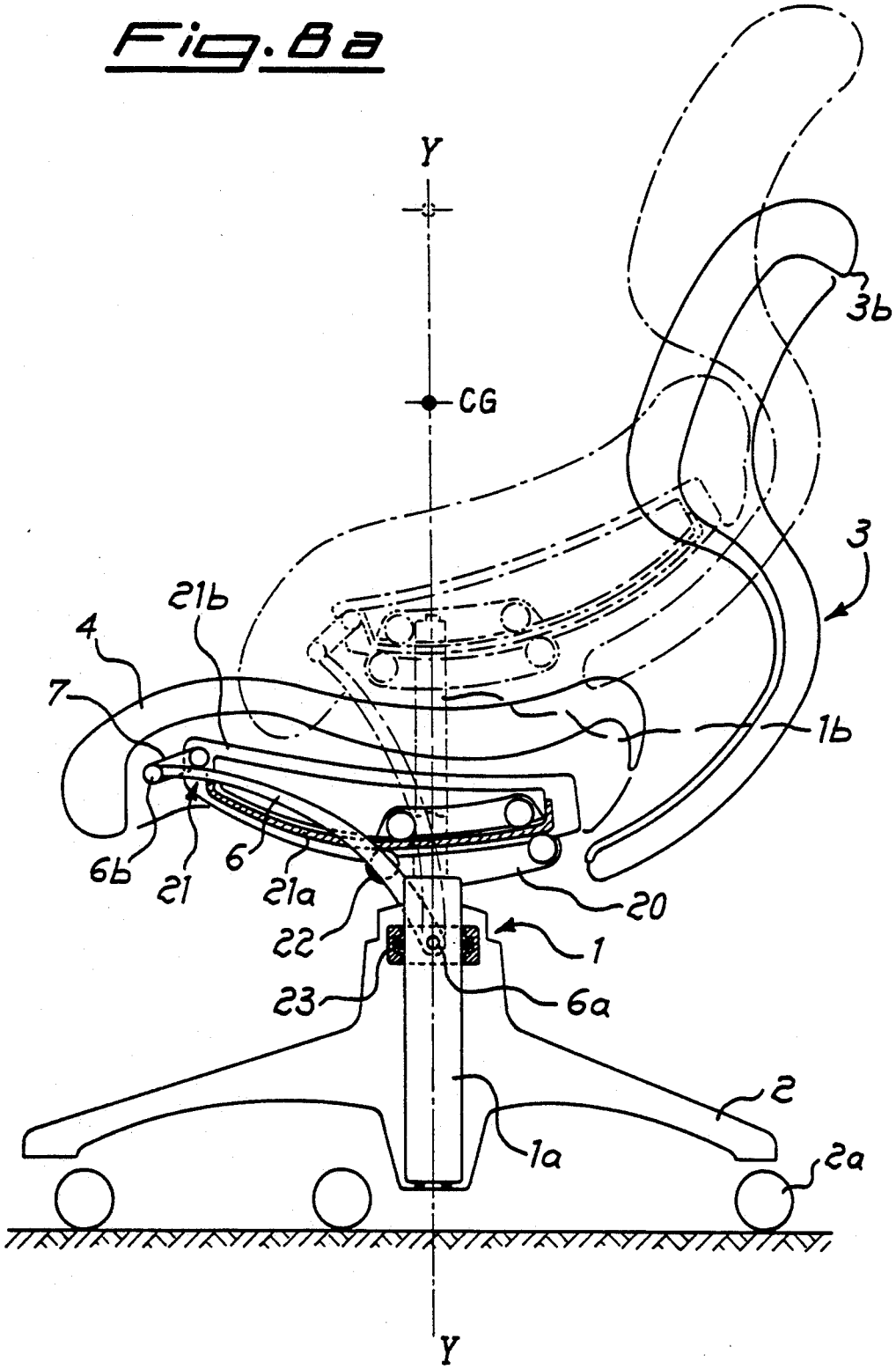
Figure 8B:
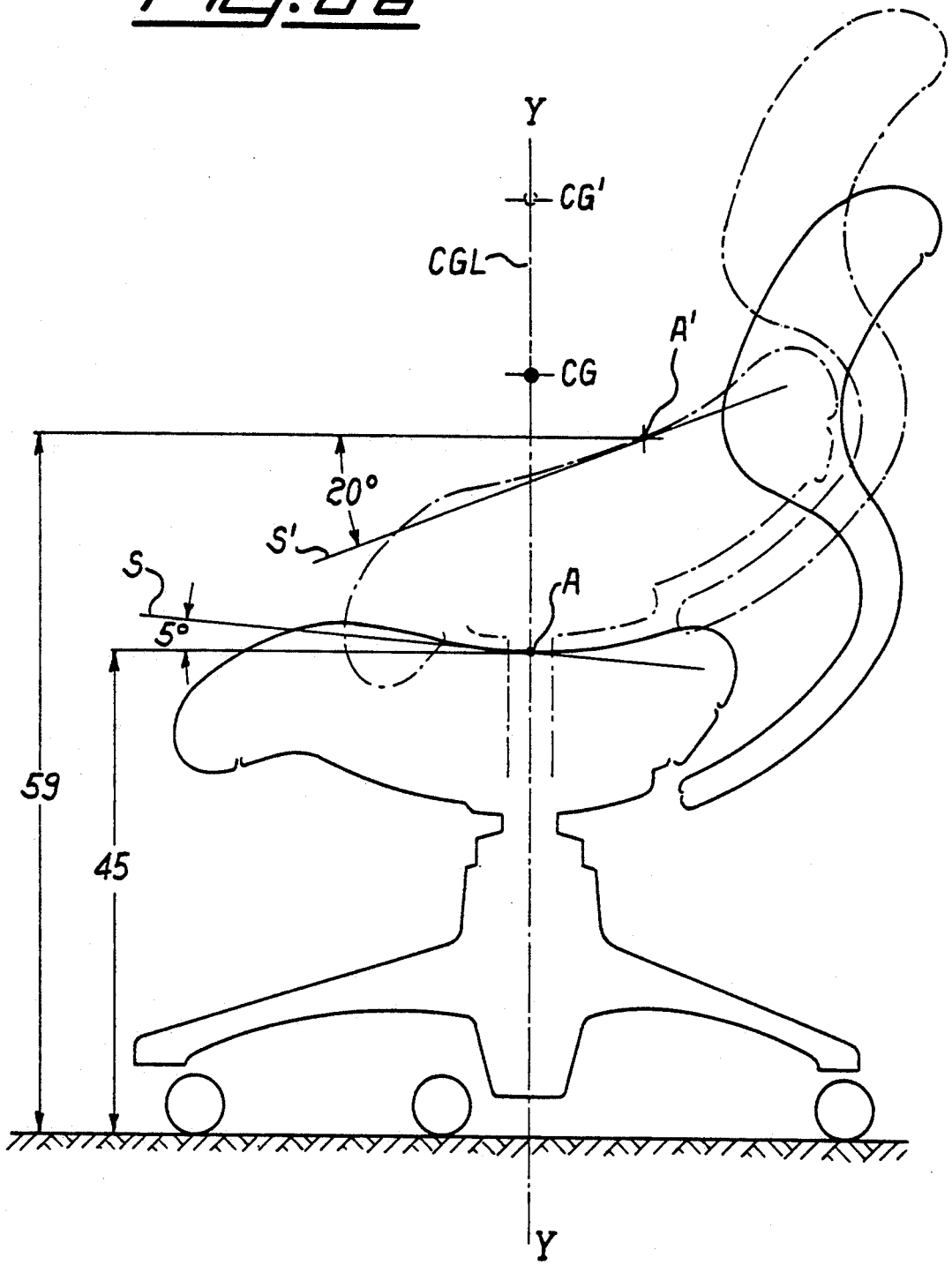
Figure 8C:
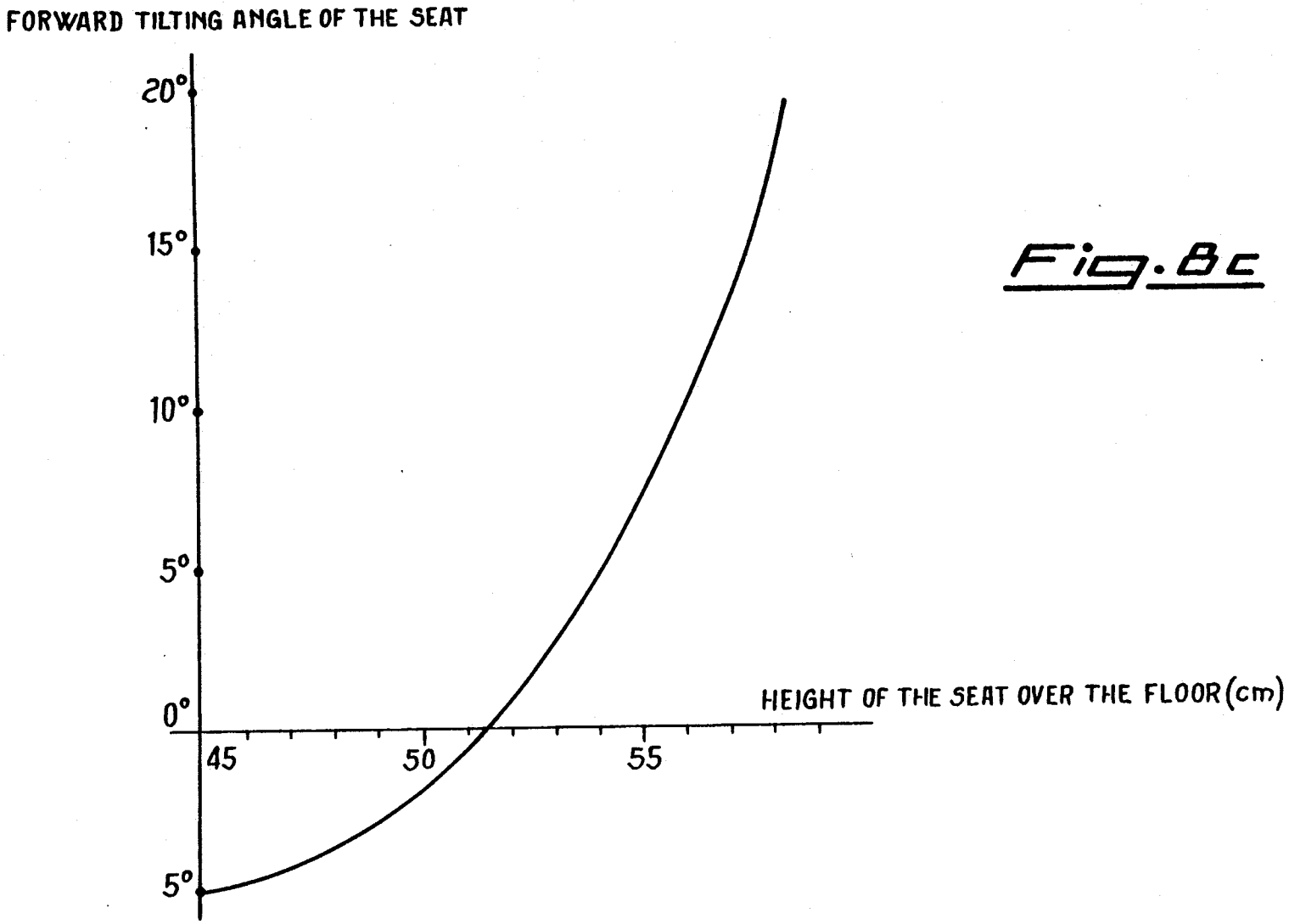

FIGS. 8*a*, 8*b* and 8*c* show and describe a preferred embodiment of the invention in which:

FIGS. 8*a* is a side view of a preferred embodiment of the chair of the present invention showing the chair at both the lowest and the highest position of the seat, respectively represented by unbroken lines and dashed and dotted lines;

FIG. 8*b* diagrammatically illustrates the seat plane of FIG. 8*a*; and

Figure 1C:
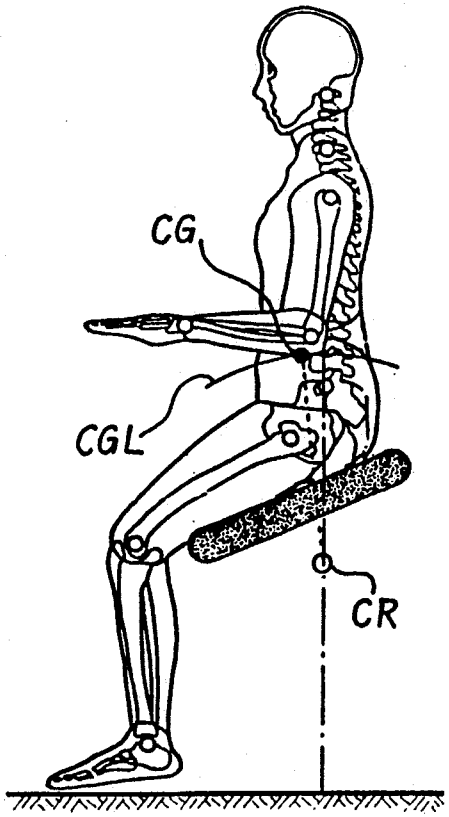
Figure 1B:
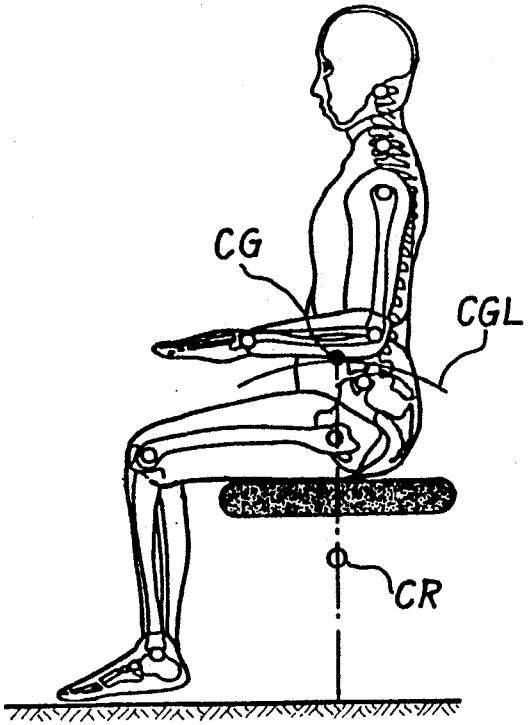
Figure 1A:
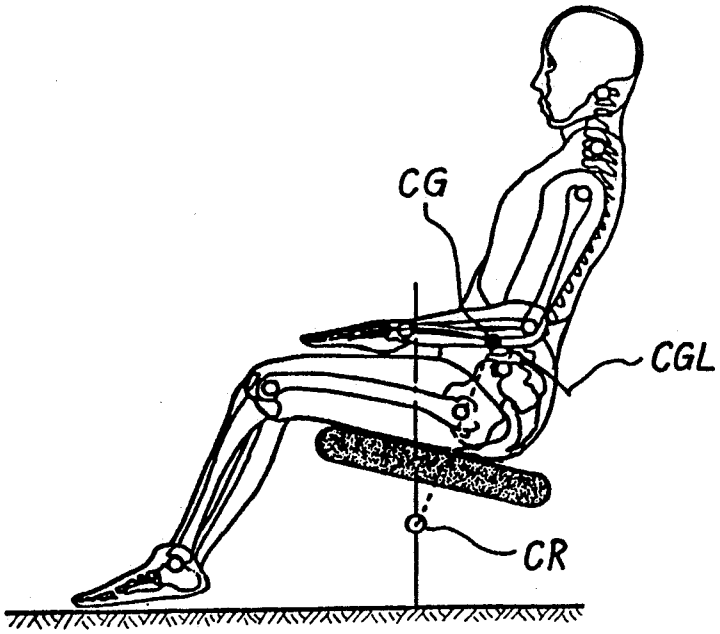

FIG. 8*c* is a graph of angle values as a function of the height of the seat of FIG. 8*a*;

With reference to the drawings FIGS. 1*a*, 1*b* and 1*c* are side views, taken from the left side of the posture assumed by a person sitting on a prior art chair being adjustable in height, the seat portion of which is tiltable and respectively positioned at a low, average and a higher level from the floor. In the situation of FIG. 1*a* it is seen that the femur is inclined along a frontally arising slope whereas the center of gravity of the sitting person, designated CG and substantially located in the vicinity of the navel, is shifted rearword to the vertical passing through the swinging center of the seat CR which is placed thereunder, substantially on the central upright supporting the same (not shown).

FIG. 1*b* shows the position of a person who has adjusted a seat height to an average value: only in this case, with horizontal seat, the center of gravity is along the vertical line passing through the point CR at a center position with respect to the base polygon, whereby this person is in equilibrium. However it is an unstable equilibrium because at a higher level (FIG. 1*c*) with the seat and therefore the femur inclined downwards, the center of gravity is dangerously shifted forward.

The center of gravity CG then moves along a line CGL, similar to an arc of circumference, when in a conventional adjustable chair the seat is changed as to the height and as a consequence also its fitting angle varies by swinging about a rotation center CR positioned thereunder. Therefore the human sitting will be subject to a sensation of instability which he will unavoidably try to oppose by exerting some muscular force involving fatigue and discomfort with the passing of time.

Figure 2C:
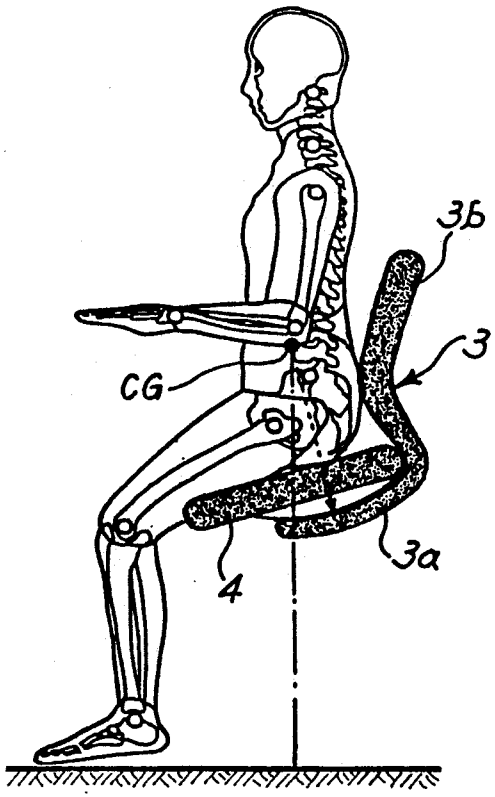
Figure 2B:
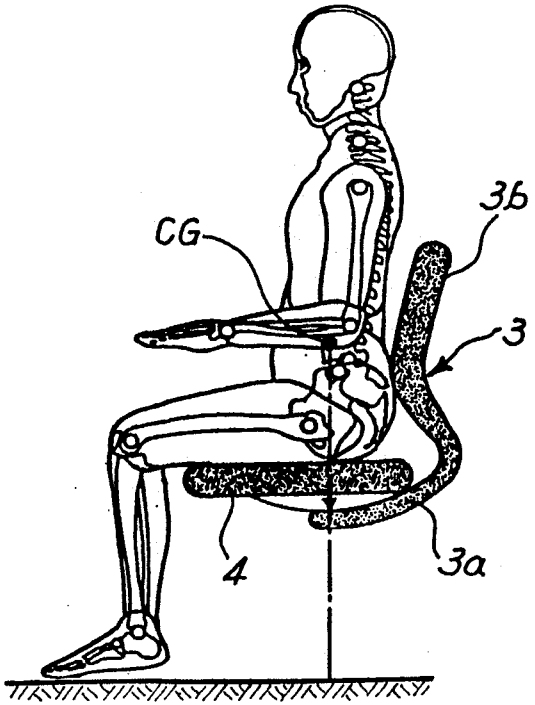
Figure 2A:
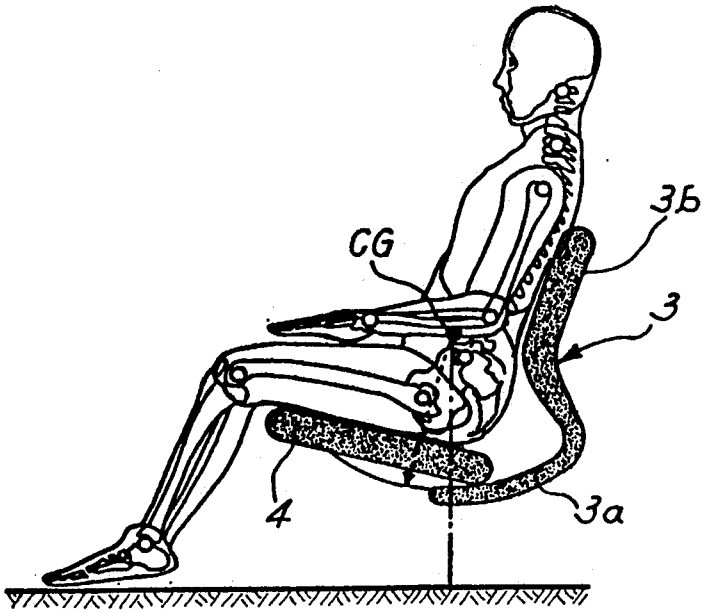

For a person sitting on a chair according to the invention, FIGS. 2*a*–2*c* show, respectively at the same heights of FIGS. 1*a*–1*c*, that the center of gravity CG of this person in any case remains on the vertical axis of support diagrammatically indicated with a dashed and doted line, even at considerable sloping angles of the seat, back or forth, with respect to the average position with horizontal seat of FIG. 2*b*.

Figure 3:
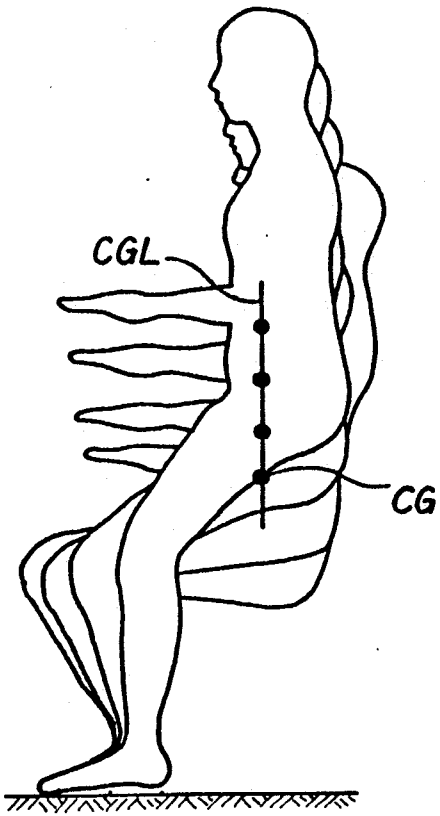
FIG. 3 shows the silhouette of a person sitting on a chair according to the invention at various heights of the seat but with his feet at the same position.

This results apparently from FIG. 3 were the overlapping profiles of a person sitting at different heights on a chair according to the invention have been shown with the feet coincident on the same position. The locus described by the center of gravity CG is a substantially vertical line CGL, without any forward or backward shifts. Every situation is therefore of stable equilibrium.

Turning now to FIGS. 2*a*–2*c* the chair central support will have, as it is known, the function of freely allowing the height to be adjusted, such as by means of gas under pressure, but however while allowing at the same time the rotation of the chair about its vertical axis indicated with a dashed and dotted line. Also a chair base, preferably with casters, has not bee shown as it is of known type, which is provided at the lower end of the vertical support. Reference character 3 denotes a support element of the seat 4 being provided at the upper end of the vertical support so as to extend rearwardly. The seat-portion supporting member 3 is formed as a surface having an arc-shape as viewed in side elevation. From the rear end of its bottom portion 3*a* a backrest 3*b* extends upwardly. Reference numeral 4 denotes a seat portion which is carried on the upper surface of the bottom portion 3*a* of the above-mentioned support member 3 in such a manner that the seat portion can slide with respect thereto back and forth.

As can be seen from FIGS. 2*a* to 2*c*, one gist of the present invention is that, as the height of the seat portion 4 of the chair according to the present invention is increased or decreased, the tilting angle of the seat portion 4 is set by a rotation about a point substantially coincident with the center of gravity of a person sitting on the chair.

The above-described ascending or descending of the seat portion and the setting of the tilting angle of the seat portion which varies in association with this ascending or descending can be embodied with a mechanism such as that schematically shown in FIGS. 4 and 5 as an example. As the height of the seat portion 4 increases, this progressively inclines toward the front of the chair by a small amount. If the seat-portion height exceeds a certain value, such as about 60 cm, the weight which is applied to the legs of the person increases and the weight which is applied to the seat portion decreases. As a reaction, the seat portion is somewhat pushed toward the rear. Therefore, in the case of a chair with casters, it is desirable to provide a caster lock mechanism to be actuated according to the height of the seat.

FIG. 4 is a side elevational schematic view of an example of the swinging mechanism for the seat relating to the chair of the present invention, in which the same reference numerals of the other figures denoted the same members, in particular the portion 3*a* of the supporting member 3 being formed as a portion of an arc which is drawn about a center of rotation ideally coincident with the average location of the center of gravity CG of the persons using the chair. Like in FIGS. 2*a*–2*c* reference numeral 4 denotes a seat portion which is carried on said portion 3*a* of the supporting member 3 and the lower surface 4*a* of the seat portion is formed in accordance with a curvature which is equal to the curvature of the portion 3*a* of the supporting member 3. Specifically, the seat portion 4 is carried on the supporting member 3 like on an arc-shaped guide in such a manner that it can swing in the opposite directions indicated by arrows in the drawings. Also the vertical support 1 has been illustrated here, which is provided with a vertical adjustment mechanism, although not shown, which allows adjustment of the height of the seat-portion supporting member 3 as it is known. This vertical support 1 is centrally mounted on a chair base 2, e.g. having radial arms with casters 2*a*.

FIG. 5 is a side elevational view, also schematic, of another example of the swinging mechanism. In this example the seat portion 4 is pivotally supported at 4*b* on a seat-portion supporting member 31 which is formed like a pillar extending up from a side of the support 1, and is suspended from the pivot axis 4*b* which substantially coincides with the center of gravity CG of a person of average height sitting thereon. In FIG. 5, 4*c* denotes a suspended arm which projects upwardly from both sides of the seat portion 4, which therefore hangs like a wing.

With solutions of this type the swinging motion of the seat 4 is completely free about the stationary center of rotation and a sitting person will automatically assume the tilting angle of the seat which is the most suitable to the particular height chosen with an unavoidable instability due to the seat being brought to return always back to the horizontal orientation of equilibrium.

With reference to FIGS. 6*a*, 6*b* the chair according to the invention has been shown with the seat portion at two different heights, in a preferred embodiment in which to avoid the above-mentioned inconvenience, the swinging movement of the seat portion 4 is accompanied by the corresponding motion of a lever 6 pivotedly mounted at an end 6*a* to the seat support 1 and in particular to the stationary portion 1*a* of such a support, also comprising a portion 1*b* adjustable in height as already indicated, such as by being telescopically mounted for an axial movement within the stationary portion 1*a* to which it is lockable at each desired position in whichever known manner. The other end 6*b* of lever 6 is pivotedly mounted to the front portion of the seat 4. The user of the chair according to the invention provides for adjusting the height of seat 4 according to his own height and the level of the working surface in front of him, while at the same time the tilting angle of the seat 4 is automatically adjusted to assume the most comfortable position at this given height of the seat and maintains this particular angle without further swinging movements.

According to a more preferred embodiment of the present invention, with reference to FIGS. 7*a* and 7*b*, the length of said lever 6 is not fixed but it is also adjustable for having more possibilities of posture which the user can obtain for a maximum comfort. In the example of embodiment of FIG. 7*a* the lever 6 is connected to the seat portion 4 through an additional lever 7 to which it is hinged in 6*b*. As the angle comprised between levers 6 and 7 varies, such as in function of the user's height, or arbitrarily, the practical consequence is that also the distance changes between the stationary pivot point 6*a* and the pivot point to the lower surface of the seat 4, in other words the tilting angle of the seat while the height is the same. FIG. 7*b* schematically shows an alternative embodiment in which the different length of lever 6 is obtained by providing the same with an elongated slot at the end opposite to pivot 6*a* and arranging the pivoting point 6*b* onto the seat 4 to be adjustable at will within said slot.

Furthermore the lever 6 may be made, instead of metal, of a relatively resilient material, such as plastic reinforced with glass fibers, so that the seat can have a certain spring-like movement about the tilting angle determined as stated before without disadvantages as to the stability of sitting which results thereby less rigid only.

In a preferred embodiment of the invention shown and described in FIGS. 8*a*–8*c*, there is illustrated a law according to which the tilting angle of the seat varies as a function of height and a slide or guide part.

FIG. 8*a* shows a side view, partially in section, of a preferred embodiment of the chair according to the invention. For the same elements as already represented in the previous figures, the same numeral references have been adopted.

The vertical support 1 comprises, more specifically, the stationary portion 1*a* of a known pump system for adjustable height chairs and its piston 1*b*. On the upper portion of the latter a supporting guide 20 of an arc-shaped slide 21 is mounted.

Slide 21 is formed as two metal profiles (only one is visible in FIG. A, with the second on the other side of the chair) fixedly joined each other by means of crossbars ensuring rigidity and stability of the slide assembly, symmetrically with respect to the axis of rotation Y—Y of the chair. Each profile comprises two elongated sections, i.e., a lower one 21*a* having an arc of circumference shape and an upper one 21*b*, fixed to the lower surface of seat 4.

The lower, curved section 21*a* is mounted between two pairs of wheels or rollers 22 rotatably mounted on the supporting guide 20 and can slide with respect to said guide, while the rotating bodies (wheels or rollers 22) reduce the friction on sliding. Obviously also the supporting guide has on the opposite side of the chair other two pairs of rotating bodies 22 for guiding the lower section of the second profile, with a suitable, solid frame for mounting them.

The center of the arc of circumference of both lower sections 21*a* is in CG, a point approximately located on vertical axis Y—Y at the center of gravity level of a person sitting on the seat 4 (corresponding to the navel, regardless of the person's height and weight).

The lever is designated 6, or generally the link connecting the stationary portion 1 of the chair with the front portion of seat 4, like in the description and claims. To better show the preferred embodiment, the lever end 6*a* at which the lever 6 is pivotedly mounted on the stationary portion 1*a* is located at a ring 23 to allow movements of rotation about the vertical axis Y—Y. Ring 23 is slidably encircling said stationary portion 1*a*at a fixed height. The opposite end 6*b* is shown linked to slide upper portion 21*b* through an additional lever 7, like in FIG. 7*a*. This lever 7 adds some adjustability to the chair, according to the user's height or for his personal comfort.

FIG. 8*a* shows the chair at both the lowest and the highest position of the seat, respectively represented by unbroken lines and dashed-and-dotted lines.

For the sake of clarity the same end positions have been outlined in FIG. 8*b*, only as far as an exemplary profile shape of the chair is concerned. The height from the floor of a point A on the seat 4 (at the intersection of seat upper surface with the vertical axis Y—Y when the lower position) is shown to vary from 45 to 59 cm. While A changes to A', the center of gravity CG moves to CG' still along axis Y—Y (corresponding to CGL line of drawings) as seat height increases, as shown in FIG. 3.

FIG. 8*b* shows also a line S that diagrammatically represents the seat plane, in average, and the angle formed by line S with the horizontal, from a slightly negative value at the lower position to about 20° when the seat is at its highest position. Those angle values have been represented in the graph of FIG. 8*c*. In function of the height of seat 4 (point A) from the floor. This is a particularly suitable and preferred "law" of variation of the seat tilting angle with respect to its height, which permits the user's feet to comfortably rest on the floor when changing the seat height, e.g. for purposes of adaptation to a different level of a working plane, as broadly discussed in the introductory portion of the specification. Of course different "laws" could be provided, depending on both the length and position of end hinge points of the lever linkage 6. Additional lever 7 allows for adjustments with respect to the indicated value of angle, whereby at each height the possible tilting angle of the seat will be that shown on the graph ±X°, where X is the variation angle allowed by link 7. It is understood that the above discussion and illustrations of FIGS. 8*a*–8*c* disclose a preferred embodiment of the basic structure of the present invention and is not intended as a limitation of the present invention as the same can be modified without escaping from the scope and principle of the present invention as claimed and disclosed herein.

As results from the foregoing description of the present invention, as the tilting angle of the seat changes according to the seat height, the latter can be smoothly and continuously moved upon changement of the posture of a person sitting on the seat while, according to the prior art, upon changing the height of the seat its tilting angle remained the same or its variation caused a forward or rearward movement of the center of gravity of the sitting person, whereby his posture was unstable and dangerous in addition to be tiring. It should also be appreciated that the tilting angle varies in an extremely smooth way with the seat swinging about a point near or coincident with the center of gravity of a person sitting on the chair as a function of the seat height. Therefore even if a person is sitting for a long time on a chair according to the invention at whichever height of the seat portion, this occurs in a comfortably way and without experiencing substantial fatigue. This in particular when adopting the preferred solution of rendering adjustable at will, especially according to the user's height, the way of varying the seat tilting angle in function of the height thereof.

Possible additions and/or modifications can be made by those skilled in the art to the above-described and illustrated embodiments of the chair according to the invention without departing from the scope of the invention itself. In particular there could be provided changements relating to the backrest portion of the chair, such as to modify for example also its slope with respect to the seat support according to the height of the latter.

I claim:

1. An ergonomic chair having a seat variably positionable in the vertical direction, comprising:

a support base, a central vertical support comprising a stationary lower portion attached to the support base and an upper portion which is vertically movable with respect to the stationary lower portion for variably positioning the seat in the vertical direction, a seat support fixed to the upper portion of the central vertical support, a seat comprising a guide means having a profile in the shape of a convex arc, the seat being in sliding relation to the seat support via the guide means, the seat support having a conforming guide receiving means, and a means for automatically adjusting the tilting angle of the seat, as defined by the position of the arc, in response to a change in vertical position of the seat, the arc being about a center of rotation substantially coincident with the average position of the center of gravity of a person sitting on the seat, the automatic adjusting means comprising the guide means and the guide receiving means, whereby the position of the center of gravity is automatically maintained along a substantially straight vertical line coaxial with the central support.

2. The chair of claim 1, said automatic adjusting means further comprising a lever arm hinged at a first end to said stationary lower portion of the central support and at a second end to said seat near the front side thereof, whereby a predetermined tilting angle of the seat corresponds to a given vertical position of the seat.

3. The chair of claim 2, wherein said lever arm has a variably adjustable length whereby the tilting angle of said seat varies as a function of the length of the lever arm.

4. The chair of claim 3, wherein said lever arm comprises an additional lever portion attached pivotally thereto at the second end thereof and said lever arm is connected to the seat via the additional lever portion, a pivot angle between the lever arm and the additional lever portion being variably adjustable.

5. The chair of claim 3, wherein said lever arm comprises at its second end an elongated slot within which said additional lever portion can be variably positioned.

6. The chair of claim 2, wherein said lever arm is made of an elastic material.

7. The chair of claim 1, wherein the guide receiving means has a profile in the shape of a concave arc.

8. The chair of claim 7, the chair further comprising a backrest, the backrest comprising a substantially vertical upper portion for supporting the back of a person sitting in the chair, and a substantially horizontal lower portion, wherein the guide receiving means of the seat support comprises the lower portion of the backrest.

9. The chair of claim 1, wherein the guide means comprises a plurality of rails and the guide receiving means comprises a plurality of sets of rollers.

* * * * *